US008550157B2

(12) United States Patent
O'Malley

(10) Patent No.: US 8,550,157 B2
(45) Date of Patent: Oct. 8, 2013

(54) APPARATUS AND METHOD FOR CONTROLLING FLOW OF SOLIDS INTO WELLBORES USING FILTER MEDIA CONTAINING AN ARRAY OF THREE DIMENSIONAL ELEMENTS

(75) Inventor: Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 398 days.

(21) Appl. No.: 12/836,371

(22) Filed: Jul. 14, 2010

(65) Prior Publication Data

US 2011/0011585 A1 Jan. 20, 2011

Related U.S. Application Data

(60) Provisional application No. 61/225,830, filed on Jul. 15, 2009.

(51) Int. Cl.
*E03B 3/18* (2006.01)
*E21B 43/08* (2006.01)

(52) U.S. Cl.
USPC ..... 166/228; 166/227; 166/278

(58) Field of Classification Search
USPC ..... 166/278, 227, 228, 235, 236; 210/337, 210/338, 488–490, 497.01
See application file for complete search history.

(56) References Cited

U.S. PATENT DOCUMENTS

| | | | | | |
|---|---|---|---|---|---|
| 1,992,718 | A | * | 2/1935 | Records | 166/228 |
| 3,273,641 | A | * | 9/1966 | Bourne | 166/276 |
| 4,821,800 | A | * | 4/1989 | Scott et al. | 166/228 |
| 5,004,049 | A | * | 4/1991 | Arterbury | 166/228 |
| 5,339,895 | A | * | 8/1994 | Arterbury et al. | 166/227 |
| 5,611,399 | A | | 3/1997 | Richard et al. | |
| 5,624,560 | A | * | 4/1997 | Voll et al. | 210/486 |
| 5,738,170 | A | * | 4/1998 | Lavernhe | 166/228 |
| 5,782,299 | A | * | 7/1998 | Simone et al. | 166/230 |
| 5,842,522 | A | * | 12/1998 | Echols et al. | 166/378 |
| 5,849,188 | A | * | 12/1998 | Voll et al. | 210/497.01 |
| 5,918,672 | A | * | 7/1999 | McConnell et al. | 166/233 |
| 5,979,551 | A | * | 11/1999 | Uban et al. | 166/233 |
| 5,980,745 | A | * | 11/1999 | Voll et al. | 210/497.01 |
| 6,125,932 | A | * | 10/2000 | Hamid et al. | 166/233 |
| 6,158,507 | A | * | 12/2000 | Rouse et al. | 166/228 |
| 6,305,468 | B1 | * | 10/2001 | Broome et al. | 166/233 |
| 2008/0217002 | A1 | * | 9/2008 | Simonds et al. | 166/230 |
| 2008/0289815 | A1 | * | 11/2008 | Moen et al. | 166/230 |
| 2009/0133874 | A1 | * | 5/2009 | Dale et al. | 166/278 |
| 2009/0229823 | A1 | * | 9/2009 | Moen et al. | 166/302 |

FOREIGN PATENT DOCUMENTS

| | | | |
|---|---|---|---|
| WO | WO9717524 | A2 | 5/1997 |
| WO | WO2007040737 | A2 | 4/2007 |

OTHER PUBLICATIONS

Canadian Intellectual Property Office, Office Action dated Feb. 21, 2003.

* cited by examiner

*Primary Examiner* — Jennifer H Gay
*Assistant Examiner* — Michael Wills, III
(74) *Attorney, Agent, or Firm* — Cantor Colburn LLP

(57) ABSTRACT

In aspects, the disclosure provides an apparatus that may include a member having fluid flow passages and a filter member placed proximate the member with the fluid flow passages, the filter member including an array of three-dimensional elements configured to inhibit flow of solid particles of a selected size when a fluid containing such solid particles flows from the filter member to the member with the fluid flow passages.

21 Claims, 11 Drawing Sheets

APPARATUS AND METHOD FOR CONTROLLING FLOW OF SOLIDS INTO WELLBORES USING FILTER MEDIA CONTAINING AN ARRAY OF THREE DIMENSIONAL ELEMENTS

CROSS-REFERENCE TO RELATED APPLICATIONS

This application claims priority to provisional application 61/225,830 filed Jul. 15, 2009.

BACKGROUND OF THE DISCLOSURE

1. Field of the Disclosure

The disclosure relates generally to apparatus and methods for controlling flow of solid particles in a fluid flowing from a formation into a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent to each production zone to extract the formation fluids into the wellbore. These production zones are sometimes separated by installing a packer between the production zones. Fluid from each production zone entering the wellbore is drawn into a tubing that runs to the surface. Substantially even drainage along the production zone is desirable, as uneven drainage may result in undesirable conditions such as an invasive gas cone or water cone. Uneven drainage may be caused by clogging or plugging of particle filtering devices, such as sand screens.

In some instances, particle filtering devices may experience wear and tear from the impact of particles from the formations causing additional restrictions of fluid flow. Accordingly, the maintenance and replacement of such devices can be costly during operation of a wellbore. Therefore, it is desired to provide apparatus and methods for removal of particles from the production fluid with reduced incidences of plugging and to provide sufficient robustness to withstand the impact of particles.

The present disclosure provides apparatus and methods for filtering particles from a production fluid that addresses some of the needs described herein.

SUMMARY

In aspects, the disclosure provides an apparatus that may include a member having fluid flow passages and a filter member placed proximate the member with the fluid flow passages, the filter member having an array of three-dimensional elements configured to inhibit flow of solid particles of selected sizes when a fluid containing solid particles flows from the filter member to the member with the fluid flow passages.

In another aspect, a method is provided that may include: providing a member having fluid flow passages; and placing a filter member proximate the member with the fluid flow passages, the filter member including an array of three dimensional elements configured to inhibit flow of solid particles of a selected size when a fluid containing such solid particles flows from the filter member to the member with the fluid flow passages.

Examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims relating to this disclosure.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters generally designate like or similar elements throughout the several figures of the drawing and wherein.

DETAILED DESCRIPTION OF THE EMBODIMENTS

Figure 1:
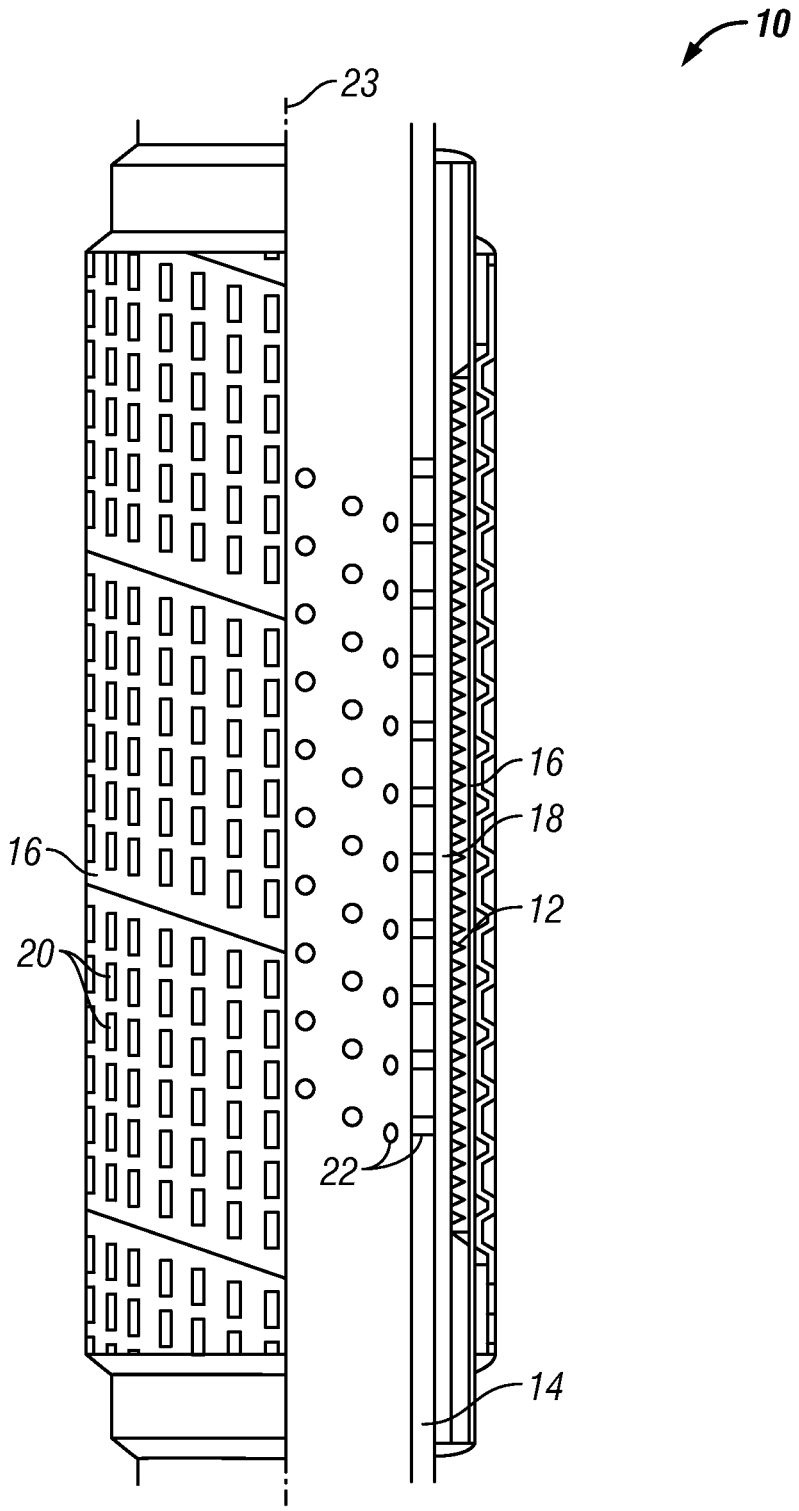
FIG. 1 is a side sectional view of an exemplary filter device with a portion of the structure removed to show the device's components, including a filter media array in accordance with one embodiment of the present disclosure.

FIG. 1 shows an exemplary filter device 10 made according to one embodiment of the disclosure that may be utilized in a wellbore for inhibiting flow of solid particles contained in a formation fluid (also referred to as "production fluid") flowing into the wellbore. The depicted filter device 10 is a side sectional view with a portion of the interior exposed to show the device's components. The filter device 10 removes unwanted solids and particulates from the production fluids. In one aspect, the exemplary filter device 10 includes a tubular member 14 having a number of flow passages 22 that allow a production fluid to enter into the tubular member 14. The filter device also includes a filter media 12 placed outside the tubular member to inhibit the flow of solid particles of selected sizes contained in the production fluid from entering into the tubular member 14. In addition, a shroud member 16 may be provided outside of the filter media 12. In one aspect, the shroud member 16 may include passages 20 sized to remove large solid particles from the production fluid prior to entering the filter device 10. In one aspect, passages 20 may have tortuous paths configured to reduce the velocity of the production fluid before it enters the filter media 12. Further, the shroud member 16 may also provide structural support to and protection from wear and tear on the filter device 10. The production fluid entering the tubular may flow along an axis 23 of the tubular 14 toward the surface of the wellbore. A standoff member 18 may be provided between the tubular member 14 and the filter media array 12. The standoff member 18 may be arranged to provide structural members while also providing spacing between filter media 12 and the tubular member 14, thereby reducing restrictions on the fluid flow from the filter media 12 to the tubular member 14. Thus, in one aspect, the standoff member 18 may provide drainage between the filter media 12 and the tubular member 14. In some embodiments, the standoff member 18 may be referred to as a drainage member or drainage assembly.

As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. As discussed below, the filter device 10 may have a number of alternative constructions that ensure particle filtration and controlled fluid flow therethrough. Various materials may be used to construct the components of the filter device 10, including metal alloys, steel, polymers, composite material, any other suitable materials having that are durable and strong for the intended applications, or any combination thereof. As depicted herein, the illustrations shown in the figures are not to scale, and may include entire assemblies or individual components which vary in size and/or shape depending on desired filtering, flow, or other relevant characteristics.

Figure 2:
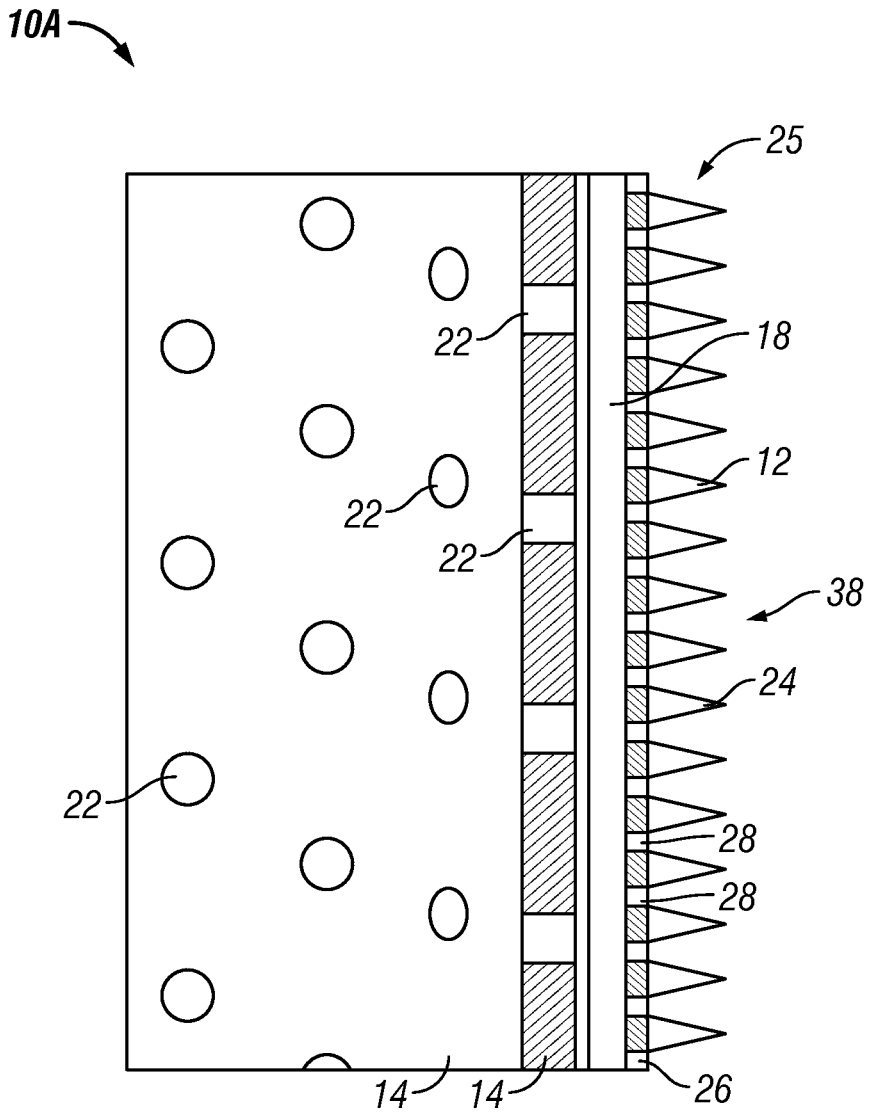
FIG. 2 is a detailed sectional side view of an exemplary filter device, including a filter media array in accordance with one embodiment of the present disclosure.

FIG. 2 illustrates a sectional side view of an exemplary filter device 10A, including the filter media 12. The filter device 10A is shown to include the filter media 12, standoff member 18, and tubular member 14. In this configuration, the filter media array 12 provides the outermost layer of filter device 10A. The filter media 12 is configured to remove particles of a selected size or larger from the production fluid. The filter media array 12 is shown to include 3D elements 24 that are configured to trap particles of a selected size. In the depicted embodiment, the 3D elements are conical-shaped. In other embodiments, as described in more detail below, the 3D elements 24 may be of various shapes, such as polyhedrons or other tapered shapes. In addition, the shapes of the 3D elements 24 may vary in the same embodiment. For example, an embodiment of the filter media array 12 may include an array of conical shaped, pyramid-shaped, and other tapered elements. Moreover, the sizes of the 3D elements may also vary within embodiments as well as among different embodiments.

Still referring to FIG. 2, an illustration the filter media 12 is shown to include a base 26 and an array 25 of 3D elements 24 placed on a side of a base 26 or base member. The base 26 provides a structural support layer to the 3D elements 24, where the elements 24 may be described as protruding from the base 26. The base 26 may also include passages 28 to enable a fluid 38 to pass through the filter media 12 into a volume created by the standoff member 18. Accordingly, particles of a selected size or larger are retained or trapped by or between the 3D elements 24 while the fluid flows through the passages 28 and along the standoff member 18 towards the passages 22 in the tubular member 14. When flowing into the tubular member 14, the fluid 38 may contain particles smaller than the selected size, which may be retained by the 3D elements. The passages 28 are sized to enable particles smaller than the selected size to flow through such passages 28 and toward the tubular member 14. In the filter device 10A, the filter media array 25 may be configured to withstand the impact of the wear of various sized particles in the fluid 25 impinging on the 3D elements 24, as this embodiment does not include a shroud. In one aspect, the 3D elements 24 may be formed from a sheet of the base 26 by stamping, forging, molding, or any other suitable process. Alternatively, 3D elements 24 may be formed separately and attached to the base 26 by any suitable process, including, but not limited to, welding, solder, glue, epoxy, adhesive, or other suitable coupling mechanism. The 3D elements 24 and the base 26 may be composed of any suitable durable material or combination of material, including, but not limited to, stainless steel, titanium, metal alloys, polymers, thermoplastics and composite materials. In one aspect, the base member 26 may be flexible in order to allow it to be wrapped around the tubular member 14. In another aspect, the filter media 12 may be preformed in a shape that may slide over or be placed around the tubular member 14. Any other method or mechanism may be used to place the filter media 12 on the outside of the tubular member 14.

Figure 3:
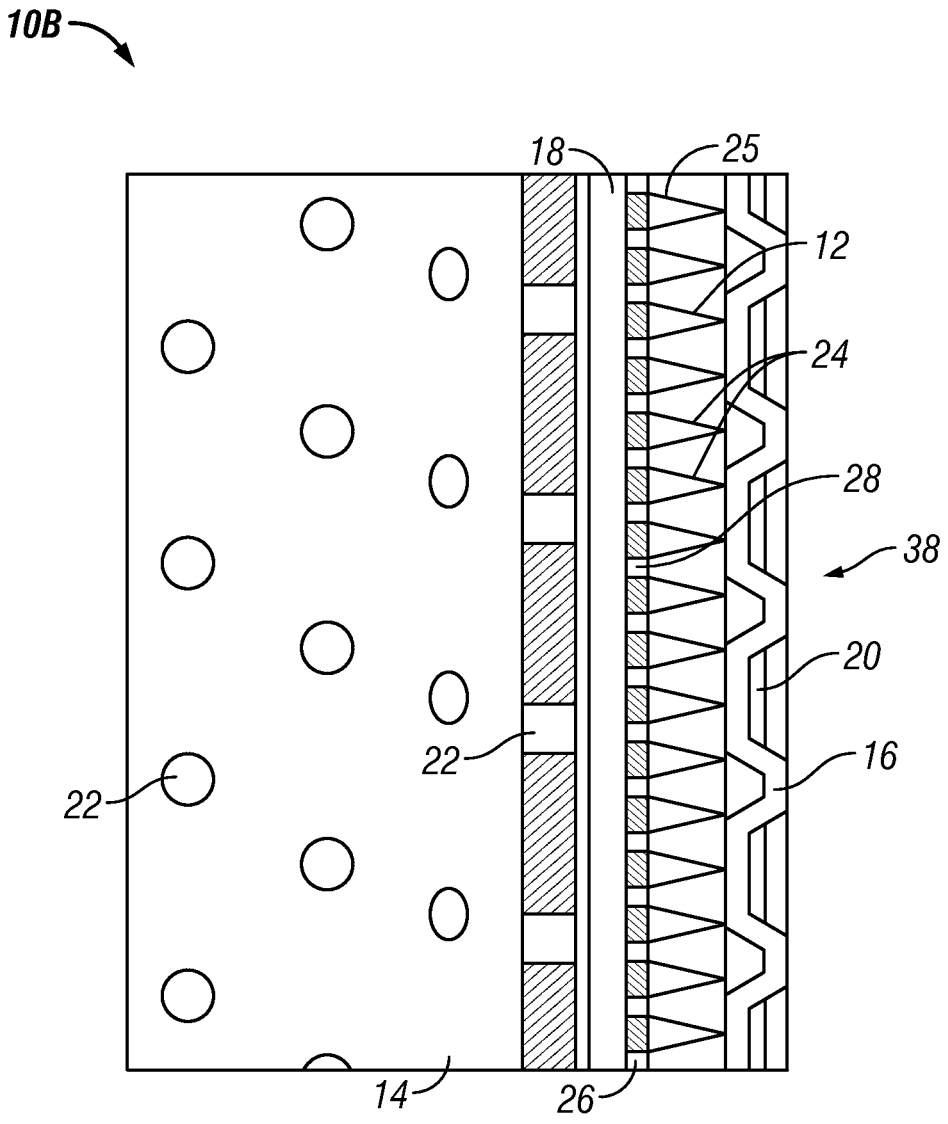
FIG. 3 is a detailed sectional side view of an exemplary filter device, including a filter media array and a shroud member in accordance with one embodiment of the present disclosure.

FIG. 3 illustrates a sectional side view of an exemplary filter device 10B, including the filter media 12 and the shroud member 16. The shroud member 16 protects the filter media 12 from direct impingement by large particles within a flowing fluid 38. Further, the passages 20 of the shroud may be configured to trap or block large particles as they attempt to pass through the shroud member 16. The filter media 12 may encounter fewer large particles, thereby reducing clogging and wear on the filter media 12.

Figure 4:
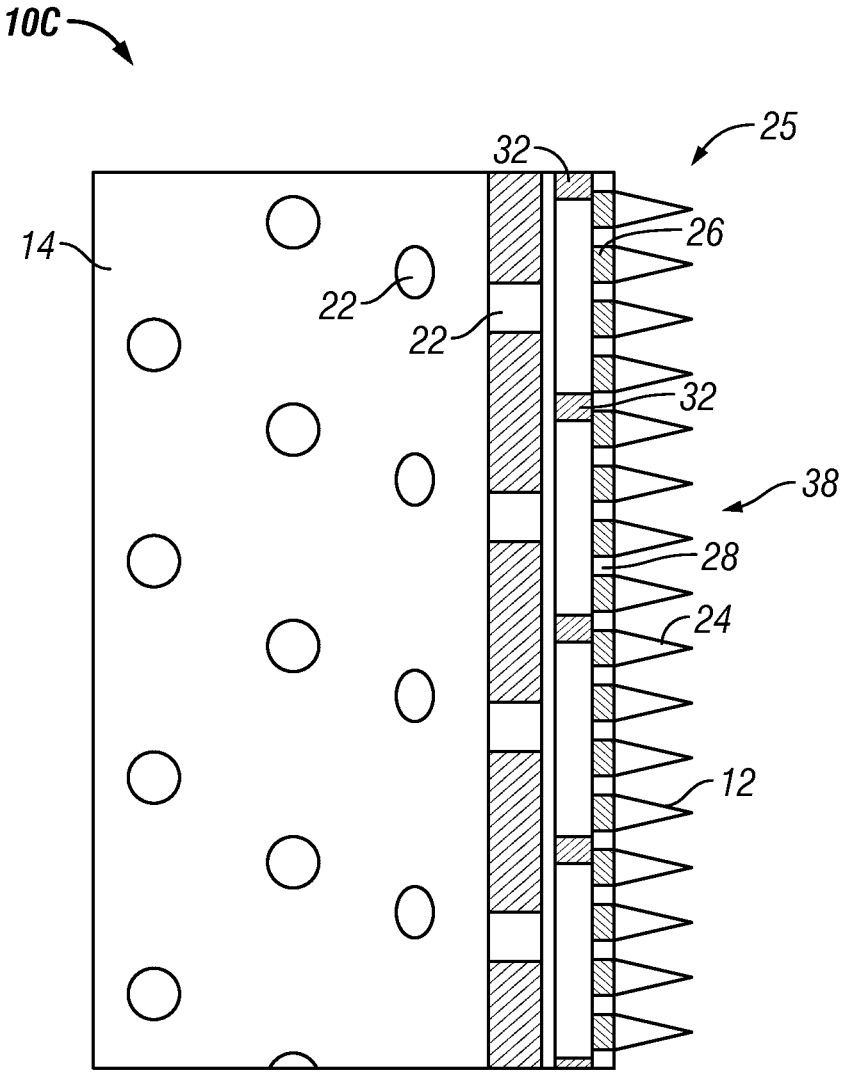
FIG. 4 is a detailed sectional side view of an exemplary filter device, including a filter media array integrated with a standoff member in accordance with one embodiment of the present disclosure.

FIG. 4 illustrates a sectional side view of an exemplary filter device 10C. In the depicted embodiment, the filter media array 12 includes standoff elements 32, which may be formed with or coupled to the base 26 of the filter media 12. The standoff elements 32 provide a volume or space for fluid flow between the filter media 12 and the tubular member 14. In one aspect, the standoff elements 32 may be attached to the base 26, which may be a sheet that may be wrapped around the tubular member 14, in the form of a pipe. Accordingly, the standoff elements 32 form rings as the filter media array 12 and the base 26 are wrapped around a tubular member. The standoff members 32 may be formed along with the filter media 12 by stamping, forging, molding, powder consolidation (similar to rapid prototyping techniques), a mask and etching process, or any other suitable process. Alternatively, the standoff members 32 may be formed separately and attached to the filter media array via welding, solder, glue, epoxy, adhesive, or other suitable coupling mechanism. In the embodiment 10C of FIG. 4, the filter media 12 is exposed directly to all particles in the fluid 38 and is configured to trap particles of a selected size or larger within the arrangement of 3D elements 24. The fluid 38, with particles of a selected size removed, flows through passages 28 and then through the volume created by the standoff members 32 toward the tubular member 14. The fluid may then flow through holes 22 into the tubular member 14.

Figure 5:
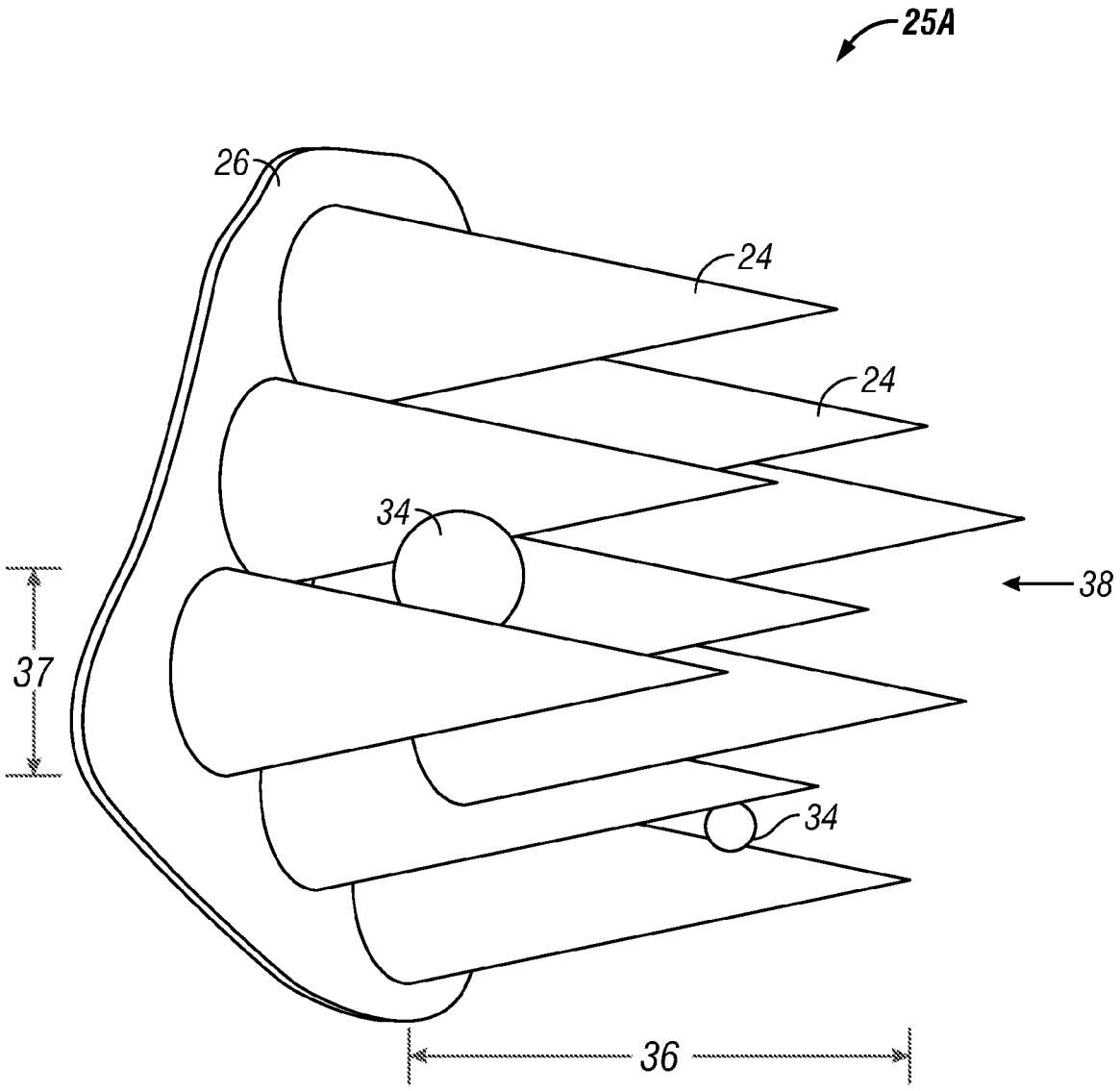
FIGS. 5-11 illustrate detailed views of exemplary filter media arrays including various three-dimensional elements in accordance with embodiments of the present disclosure.

FIGS. 5-11 illustrate various examples of the shapes and geometries of the 3D elements 24 that may be utilized for trapping particles of selected sizes within the filter media array. The array may include any combination of shapes and sizes of 3D elements to achieve the desired filtering capabilities. FIG. 5 shows a perspective view of a filter media array 25A of a section of the filter media 12. The array 25A includes cone-shaped 3D elements 24 configured to trap certain particles, such as particles 34. In one aspect, a height 36 and base size 37 of the 3D elements 24 may be chosen based on the expected distribution of particle sizes within the formation fluid flow 38 such that particles of a selected size and above will be trapped in the array 25. Accordingly, the height 36 and base size 37 may vary according to the application and may vary between the 3D elements 24 of a particular application. For example, in a formation with a normal distribution of particle sizes, the array 25 may be configured to retain the median-sized particles at approximately the midpoint of the 3D elements 24, or one half of the height 36. Such a configuration may trap median and larger-sized particles 34 in the array 25A. Particles smaller than the selected median-sized particle may also be trapped behind the median and larger-sized particles 34 after they are lodged between the 3D elements. However, some particles smaller than the median-sized particle may flow beyond the 3D elements and through the base 26 of the filter media. Therefore, the selected size of particles to be trapped is a range of sizes that will be retained. The production fluid, with the selected particles removed, flows through passages 28 located between the 3D elements toward the tubular member 14. The relationship between 3D element height 36 and particle distribution may apply to any element geometry, including those illustrated in FIGS. 5-11.

Figure 6:
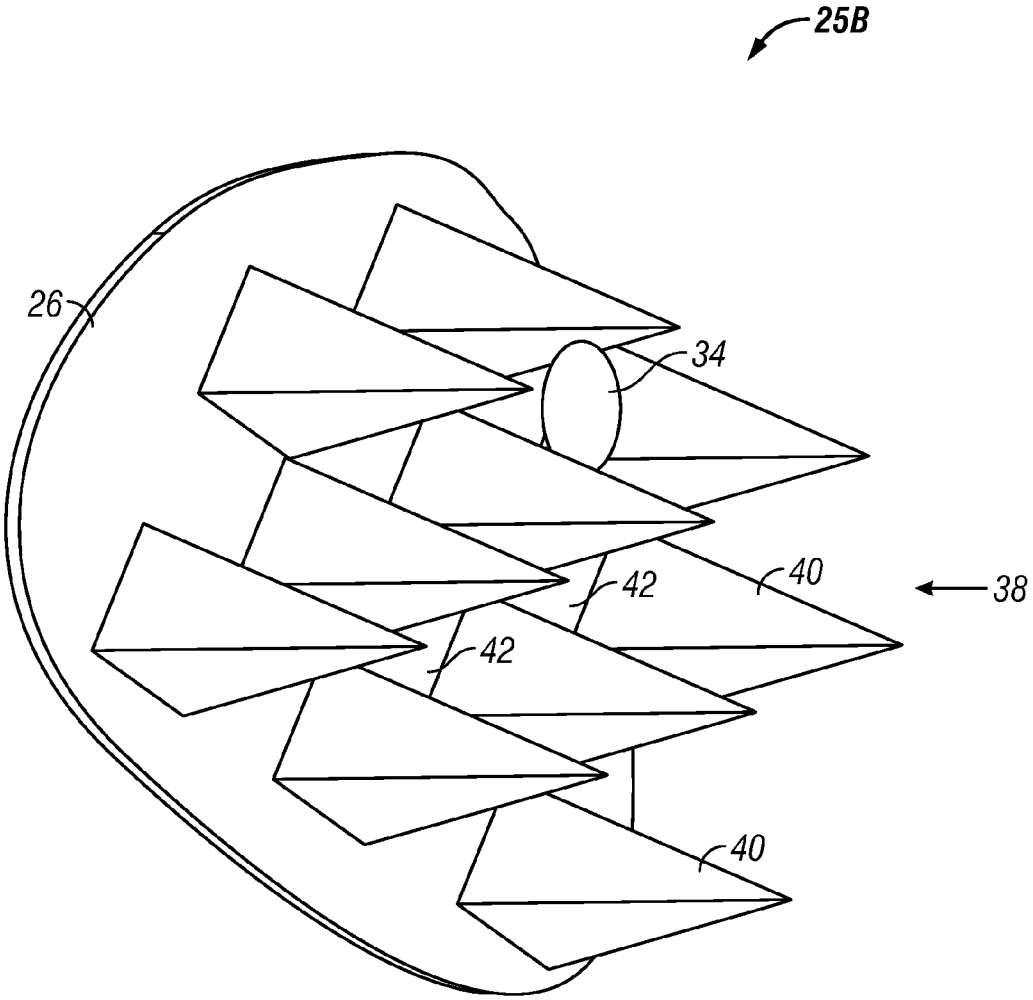

FIG. 6 shows a perspective view of another filter media array 25B of a section of the filter media 12. The filter media array 25B is configured to trap particles of selected sizes, such as particles 34. The filter media array 25B is shown to include pyramid-shaped 3D elements 40 attached to the base 26. Passages 42 may be located in the base 26 in between the pyramid-shaped 3D elements 40 to enable the fluid flow 38 into the tube after the selected particles 34 are retained by the elements. The pyramid shape of the elements 40 is a type of polyhedron. Any number of tapered polyhedron or conical shapes may be utilized in the filter media array 12 to remove particles.

Figure 7:
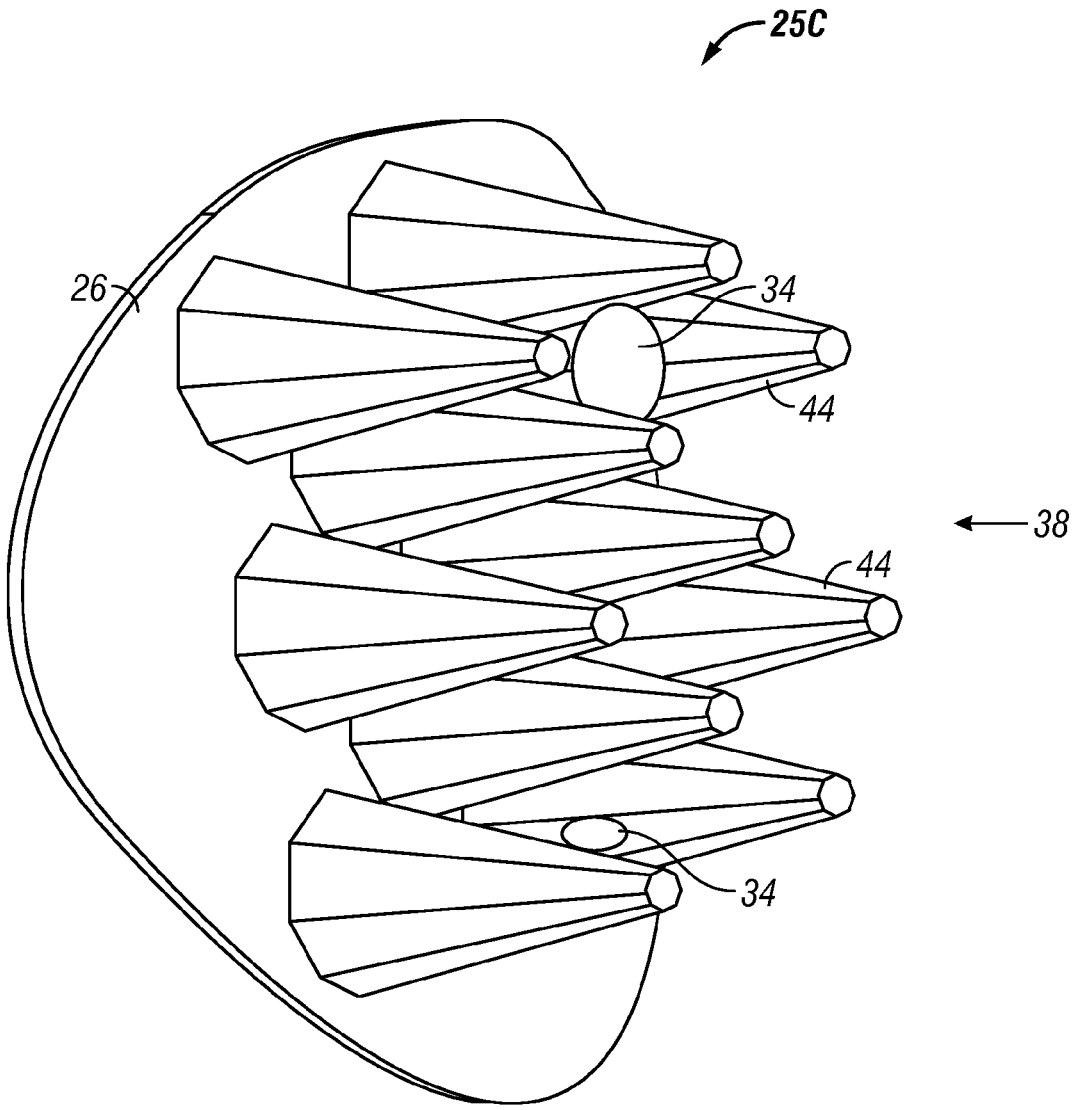

FIG. 7 shows a perspective view of yet another filter media array 25C of a section of the filter media 12. The filter media array 25B is configured to trap particles of certain sizes, such as particles 34. The filter media array 25C is shown to include multi-faceted 3D cone elements 44 attached to the base 26. Passages may be located in the base 26 in between the 3D cone elements 44 to enable a fluid 38 to flow into the tubular member 14 after the selected particles 34 are retained by the 3D cone elements 44. The particles 34 may trap other particles behind them and against the 3D cone elements 44 as the fluid 38 flows toward the tubular 14. The multi-faceted cone shape of the 3D cone elements 44 is a type of a polyhedron utilized to trap selected particles of a production fluid.

Figure 8:
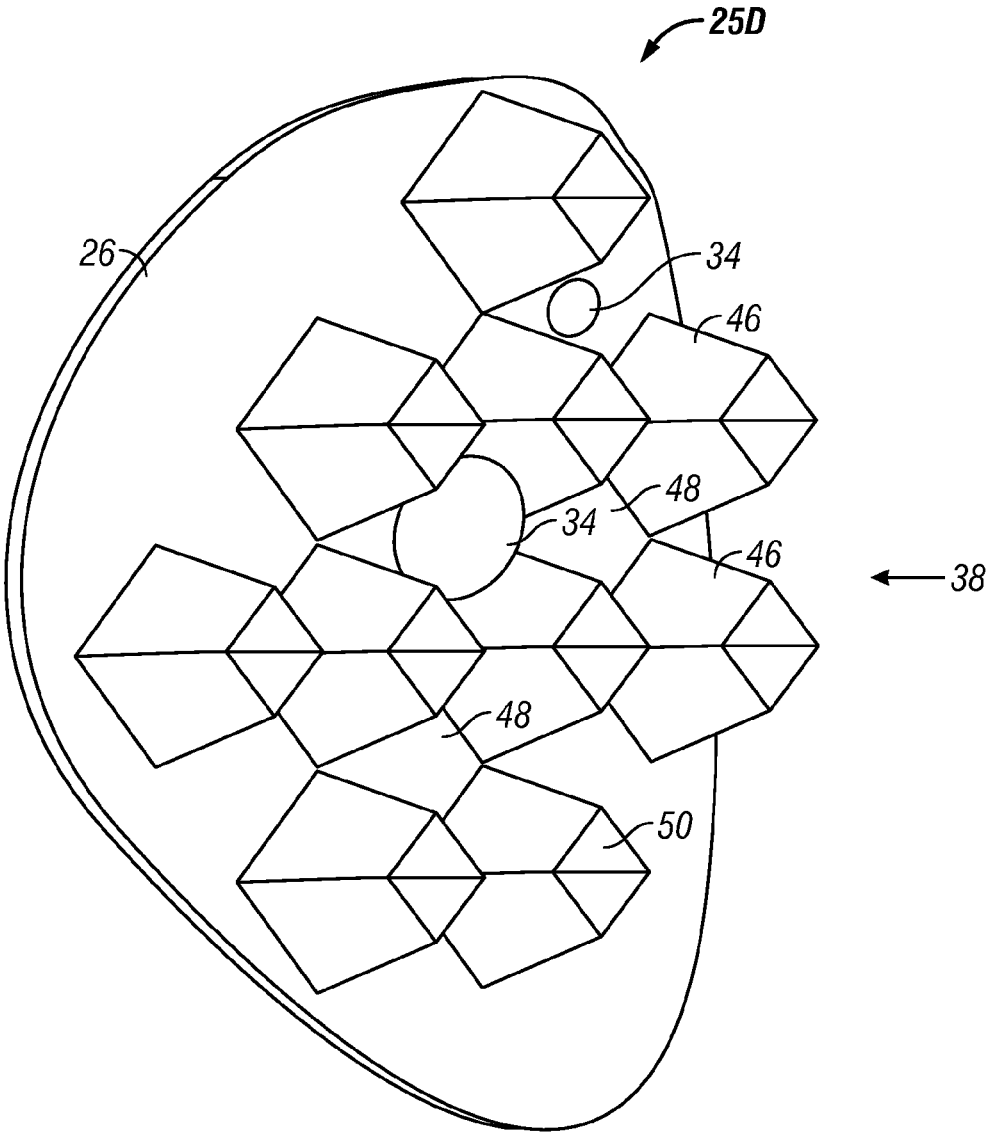
Figure 9:
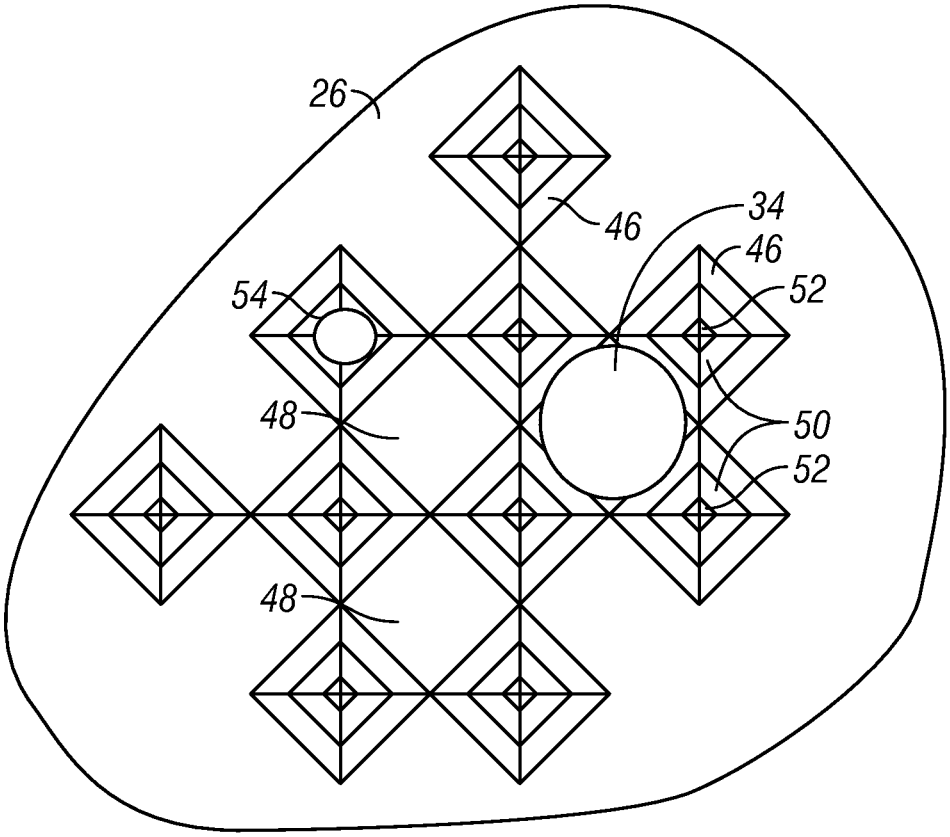

FIG. 8 shows a perspective view of another filter media array 25D of a section of the filter media 12. The filter media array 25D is configured to trap selected particles, such as particles 34. FIG. 9 is a top view of the filter media array 25D shown in FIG. 8. The filter media array 25D includes truncated pyramid 3D elements 46 attached to the base 26. Passages 48 may be located in the base 26 in between the truncated pyramid 3D elements 46 to enable fluid 38 to flow toward the tubular member 14 after the selected particles 34 are retained by the 3D elements 46. In one aspect, an upper face 50 of the 3D elements 46 may be a flat or a substantially flat surface. In another aspect, the upper face 50 may include passages 52 configured to enable additional fluid flow through the filter media array 25D. In addition, the passages 52 may be sized to trap particles 54 of a second selected size, enabling the filter media array 25D to trap particles of various sizes and ranges. The truncated pyramid shape of the elements 46 also is a type of polyhedron.

Figure 10:
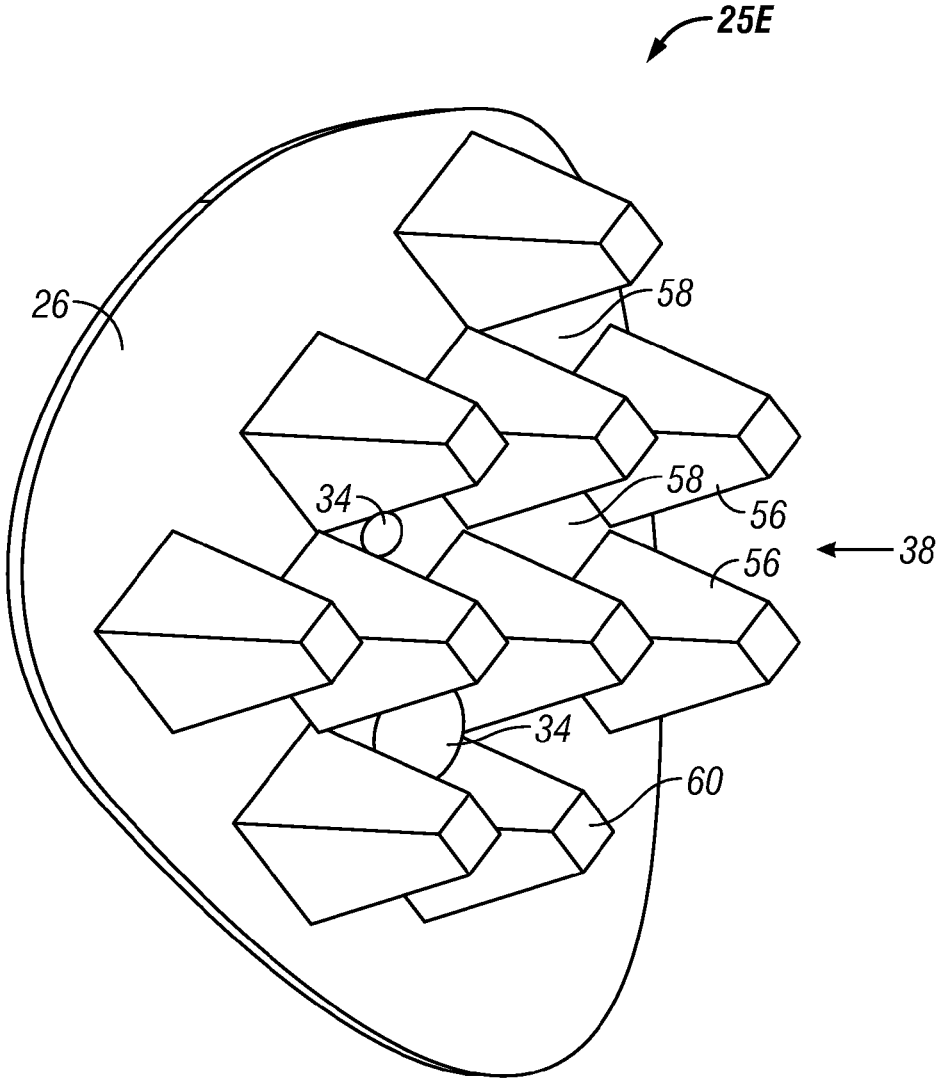
Figure 11:
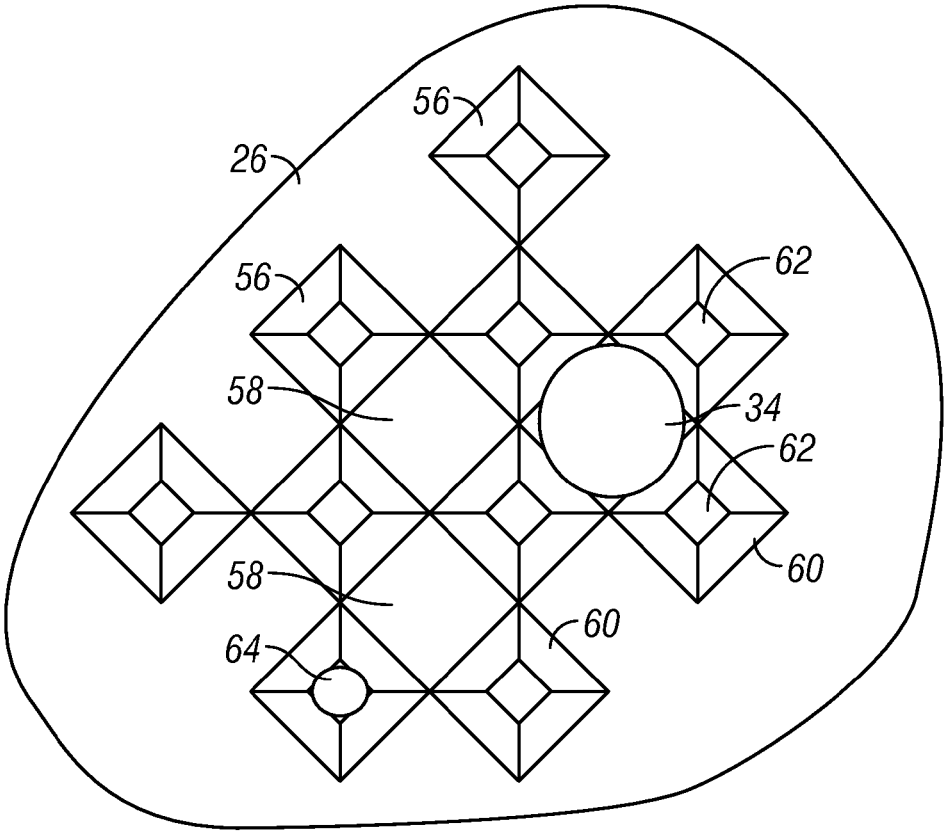

FIG. 10 shows a perspective view of another filter media array 25E of a section of the filter media 12. The filter media array 25E is configured to trap particles of a selected size or range of sizes, such as particles 34. FIG. 11 is a top view of the filter media array 25D shown in FIG. 10. The filter media array 25E is shown to include extended truncated pyramid 3D elements 56 attached to the base 26. Passages 58 may be located in the base 26 between the extended truncated pyramid 3D elements 56 to enable fluid 38 to flow toward the tubular member 14 after the selected particles 34 are retained by the extended truncated pyramid 3D elements 56. In one aspect, an upper face 60 of the extended truncated pyramid 3D elements 56 may be a flat or substantially flat surface. In another aspect, the upper face 60 may include passages 62 configured to enable additional fluid to flow through the filter media array 25E. The passages 62 may be sized to trap particles 64 of a second selected size, enabling the filter media array 25E to trap particles of various sizes and ranges. The extended truncated pyramid shape of the elements 56 also is a polyhedron.

Thus, in one aspect, the disclosure provides a filter device that in one embodiment may include a member with flow passages, and a filter media placed on a side of the member, wherein the filter media include an array of 3D elements configured to trap solid particles of a selected size as a fluid containing such solid particles flows through the filter media. In one aspect, the filter media may include a base member to which the 3D elements are attached. In one aspect, the three dimensional elements may protrude from the base member.

The 3D elements may be attached to the base via stamping, welding, forging, molding, bonding, or any combination thereof. In one aspect, the member with the passages may be a tubular member and the base member may be a flexible member wrapped around the tubular member. In another aspect, the filter media may be in the form of a tubular with the array of the 3D elements on an outside surface of the tubular.

In another aspect, the filter device may include a flow passage between the member with the passages and the filter media. In another aspect, the filter device may further include a shroud on a side of the filter media configured to inhibit flow of particles of a second selected size from impinging on the filter media. In another aspect, the shroud includes tortuous passages therein configured to reduce velocity of a fluid entering into the shroud. In another aspect, the filter device is a sand screen suitable for use in an oil well to prevent the flow of solid particles of particular sizes contained in production fluids from entering into the well.

In another aspect, a method of making a filter device is disclosed, which method, in one embodiment, may include: providing a member with flow passages, and placing a filter media on a side of the member, wherein the filter media include an array of 3D elements configured to trap solid particles of a selected size as a fluid containing such solid particles flows through the filter media. In one aspect, placing the filter media may further include attaching the three-dimensional elements to a base member and placing the base member on the side of the member with passages. In another aspect, the 3D element may be selected from a group that includes conical-shaped elements, polyhedron-shaped or a combination thereof. In another aspect, the 3D elements may protrude from the base member. Attaching the 3D element to the base may include one or more of stamping, welding, forging, molding, bonding or any combination thereof. In another aspect, the member with the passages may be a tubular member and the method may further include wrapping the base member around the tubular member. In another aspect, placing the filter media may include forming the filter media in the form of a tubular and placing the filter media on an outside of the tubular member. In another aspect, the method may include placing a shroud outside the filter media. In yet another aspect, the method may include placing the filter device in a wellbore to inhibit flow of particles of selected sizes in the production fluid to flow into the wellbore. The method may further include producing the production fluid from the wellbore.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. An apparatus for use downhole, comprising:

a member with flow passages; and a filter media placed on a side of the member, wherein the filter media comprises a base member with an array of pyramid-shaped or conical-shaped elements attached to the base member, the pyramid-shaped or conical-shaped elements being configured to trap solid particles of a selected size as a fluid containing the solid particles flows through the filter media.

2. The apparatus of claim 1, wherein the pyramid-shaped or conical-shaped elements are tapered in a radial direction to trap larger particles at a first position relative to the base member and trap smaller particles at a second position relative to the base member, where the second position is closer to the base member than the first position.

3. The apparatus of claim 1, wherein the base member comprises passages to enable the fluid to pass through the filter media.

4. The apparatus of claim 1, wherein the pyramid-shaped or conical-shaped elements are attached to the base via stamping, welding, forging, molding, bonding, or any combination thereof.

5. The apparatus of claim 1, wherein the member with flow passages is a tubular member and the base member is a flexible member wrapped around the tubular member.

6. The apparatus of claim 1, wherein the filter media comprises a tubular with the array of pyramid-shaped or conical-shaped elements on an outside surface of the tubular.

7. The apparatus of claim 1, comprising a flow passage between the member with flow passages and the filter media.

8. The apparatus of claim 1, comprising a shroud on a side of the filter media configured to inhibit flow of particles of a second selected size from impinging on the filter media.

9. The apparatus of claim 8, wherein the shroud comprises tortuous passages therein configured to reduce velocity of a fluid entering into the shroud.

10. The apparatus of claim 1, wherein the member and filter media comprise a sand screen suitable for use in a well to prevent the flow of solid particles of particular sizes contained in production fluids from entering into the well.

11. A method of making a downhole filter device, the method comprising:

providing a member with flow passages; and placing a filter media on a side of the member, wherein the filter media comprises a base member with an array of pyramid-shaped or conical-shaped elements protruding from the base member, the pyramid-shaped or conical-shaped elements being configured to trap solid particles of a selected size as a fluid containing the solid particles flows through the filter media.

12. The method of claim 11, wherein the array of pyramid-shaped or conical-shaped elements further comprises an array of both pyramid-shaped and conical-shaped elements.

13. The method of claim 11, wherein the pyramid-shaped or conical-shaped elements protrude from the base member.

14. The method of claim 11, wherein placing the filter media comprises attaching pyramid-shaped or conical-shaped elements to the base using one selected from the group consisting of stamping, welding, forging, molding, bonding or any combination thereof.

15. The method of claim 11, wherein the member with flow passages is a tubular member and the method comprises wrapping the base member around the tubular member.

16. The method of claim 11, wherein placing the filter media comprises forming the filter media in the form of a tubular and placing the filter media on an outside of the tubular member.

17. The method of claim 11, comprising placing a shroud outside the filter media.

18. The method of claim 11, wherein the filter device is configured to be placed in a wellbore to inhibit flow of particles of selected sizes in a production fluid to flow into the wellbore.

19. The method of claim 18, comprising producing the production fluid from the wellbore.

20. A downhole filtering apparatus, comprising:

a tubular member with flow passages;

a base member wrapped around the tubular member; and an array of pyramid-shaped or conical-shaped elements attached to the base member, wherein the array of pyramid-shaped or conical-shaped elements is configured to trap solid particles of a selected size as a fluid containing the solid particles flows through the array of radially protruding tapered elements.

21. The apparatus of claim 1, wherein the pyramid-shaped or conical-shaped elements further comprises at least one of (i) a truncated pyramid-shaped element; and (ii) a conical-shaped element.

* * * * *